US007942179B2

(12) United States Patent
Storm-Nielsen

(10) Patent No.: US 7,942,179 B2
(45) Date of Patent: May 17, 2011

(54) DEVICE FOR DISPENSING LABELS

(75) Inventor: Jens Storm-Nielsen, Holbaek (DK)

(73) Assignee: Elmoprint APS Maskinfabrik, Holbaek (DK)

( * ) Notice: Subject to any disclaimer, the term of this patent is extended or adjusted under 35 U.S.C. 154(b) by 467 days.

(21) Appl. No.: 11/817,372

(22) PCT Filed: Mar. 31, 2006

(86) PCT No.: PCT/DK2006/000182

§ 371 (c)(1),
(2), (4) Date: Aug. 29, 2007

(87) PCT Pub. No.: WO2006/105788

PCT Pub. Date: Oct. 12, 2006

(65) Prior Publication Data

US 2008/0142162 A1 Jun. 19, 2008

(30) Foreign Application Priority Data

Apr. 4, 2005 (DK) ..... PA 2005 00887

(51) Int. Cl.
*B65C 9/08* (2006.01)

(52) U.S. Cl. ..... 156/361; 156/362; 156/542

(58) Field of Classification Search ..... 156/361, 156/362, 542

See application file for complete search history.

(56) References Cited

U.S. PATENT DOCUMENTS 4,046,613 A * 9/1977 Kucheck et al. ..... 156/249
4,324,608 A 4/1982 Klinger et al.
5,133,827 A 7/1992 Ratermann et al.
5,472,552 A * 12/1995 Speranza et al. ..... 156/351

FOREIGN PATENT DOCUMENTS

DE 197 16 651 A1 10/1998
DE 102 28 243 A1 1/2004

OTHER PUBLICATIONS

International Search Report corresponding to International Application No. PCT/DK2006/000182, European Patent Office, Jun. 13, 2006, 2 pages.
Written Opinion corresponding to International Application No. PCT/ DK2006/00182, European Patent Office, Jun. 13, 2006, 5 pages.
International Preliminary Report on Patentability corresponding to International Application No. PCT/DK2006/000182, International Bureau of WIPO, Oct. 9, 2007, 6 pages.

* cited by examiner

*Primary Examiner* — Khanh Nguyen
*Assistant Examiner* — John Blades
(74) *Attorney, Agent, or Firm* — Vedder Price P.C.

(57) ABSTRACT

The invention relates to a device for dispensing a plurality of labels onto a folio across a travelling path of the folio through the device, the device has a supply of labels, the labels are carried by a carrier; a guide system for guiding the carrier with labels from the supply to a dispenser. The dispensing machine includes an arm, which extends across the folio, and a dispensing wagon, which is arranged on the arm and is adapted to dispense the labels onto the folio while moving along the arm. The device furthermore keeps the carrier stretched between the supply and the dispenser.

9 Claims, 5 Drawing Sheets

DEVICE FOR DISPENSING LABELS

FIELD OF THE INVENTION

The present invention relates to a device for dispensing a plurality of labels onto a folio as the folio travels across a travelling path through the device. The device comprises a supply of labels which are carried by a carrier. The guide system guides the carrier with labels from the supply to a dispensing means. The dispensing means comprises an arm, which extends across the folio, and a dispensing wagon, which is arranged on the arm and is adapted to dispense the labels onto the folio while moving along the arm.

BACKGROUND ART

Cross web labelling machines are known in the prior art. These machines are adapted to dispense labels onto a folio or other packaging material.

Dispensing of labels in these machines is often performed by the labels being supplied to a dispensing area. At the dispensing area the labels are removed from the carrier and transported to an application place often via a so-called vacuum box. After being transported to the application place, the labels are applied to the folio, the procedure is repeated continuously with new labels.

This known method has the following disadvantages; the positioning of the labels during their transport to the application place is unstable, i.e. there is a great risk of the labels not being applied correctly to the folio; the application of the labels to the folio is performed by applying the labels substantially perpendicular to the surface of the folio with the entire label surface at once, i.e. there is a risk that there will be air bubbles between the labels and the folio. The result may be a contaminated, non-hygienic label, especially unwanted when the packaging material is being used for food stuffs, medical devices or medicines. During transport from the carrier to the application point the labels are exposed to air which also may contaminate the adhesion surface between the label and the folio. This is a problem when the label is of the type which is adapted to be peelable, i.e. it can be lifted and replaced on the folio several times. The adhesion surface of the label is exposed which may result in the labels creasing and sticking to things during stop in operation, which thereby may require cleaning of the machine before operation is resumed. Also there may be a high waste of labels.

SUMMARY OF THE INVENTION

An object of the present invention is to wholly or partly overcome the above disadvantages and drawbacks of the prior art. More specifically, it is an object to provide a device for dispensing a plurality of labels onto a folio across a travelling path of the folio through the device.

It is an object of the present invention to provide a device which has a high operating durability and which minimizes the amount of label wasted during interruptions in the operation.

Another object of the present invention is to provide a device which substantially avoids air bubbles between the label and the folio.

A further object of the present invention is to provide a device wherein the adhesion surface of the label is not exposed to air before being dispensed onto the folio.

The above objects, together with numerous other objects, advantages and features, which will become evident from the below description, are accomplished with the present invention which provides means for keeping the carrier with a predetermined stretch as the carrier travels between the supply and the dispensing means.

Hereby, a device is provided which can dispense a high number of labels in a short period of time without the carrier being damaged. Also, the labels are dispensed directly from the carrier onto the folio without substantially being exposed to air, whereby a dispensed hygienic label is obtained, which is especially desirable when being used for foodstuffs as well as medicine.

In a preferred embodiment according to the invention a buffer unit for containing a supply of labels may be arranged in connection with the means for keeping the carrier with the predetermined stretch. Whereby the inertia created by the form of the supply, which often is in the form of a roll, is avoided.

In an expedient embodiment according to the invention a storing unit for the empty carrier may be arranged in connection with the dispensing means.

According to the invention, means for keeping the empty carrier with a predetermined stretch may be arranged between the dispensing means and the storing unit. The means for providing a predetermined stretch is preferably connected and arranged between the storing unit and the dispensing means. The carrier also is stretched after the labels have been dispensed. Additionally it is important that the carrier is stretched so that there will not be any slack in the carrier during dispensing as this will influence the continuous operation of the device. In the worst case slack may result in the carrier being damaged which will cause interruption in the labelling procedure.

Advantageously, the means for keeping the carrier with the predetermined stretch may comprise a slide, which is in connection with a drive means. The slide is adapted to move back and forth in relation to the back and forth movement of the dispensing wagon on the arm, thereby continuously changing the distance between the supply and the dispensing wagon in relation to the instantaneous position of the dispensing wagon on the arm.

Furthermore, the drive means may be a servo motor. The servo motor may be adapted to move the slide back and forth by means of a precision belt. During operation of the device it is of high importance that the clearance of the dispensing wagon is reduced to an almost imperceptible level. If the clearance is too big this will result in inaccurate positioning of the labels on the folio. This may advantageously be avoided by using a precision belt according to one aspect of the invention.

According to the invention the buffer unit may also comprise a slide, which is connected to a drive means, the slide being adapted to move back and forth in relation to the back and forth movement of the dispensing wagon on the arm as well as the slide, thereby continuously changing the distance between the supply and the dispensing wagon so that the supply of labels contained in the buffer unit at all times relates the instantaneous dispensing need of labels at the dispensing wagon.

Advantageously according to the invention a control unit may be arranged, the control unit being adapted to control the dispensing of labels in relation to the speed of the folio as well as to the speed of the movement of the slides.

Also according to the invention a printer may be arranged in connection with the guiding system of the carrier so that information is printed on the labels before they are dispensed. Such information may for instance be a packaging date, expiration date, price, etc.

BRIEF DESCRIPTION OF THE DRAWINGS

The invention and its many advantages will be described in more detail below with reference to the accompavying schematic drawings, which for the purpose of illustration show some non-limiting embodiments and in which.

All the figures are highly schematic and not necessarily to scale, and they show only parts which are necessary in order to elucidate the invention, other parts being omitted or merely suggested.

DESCRIPTION OF PREFERRED EMBODIMENTS

Figure 1:
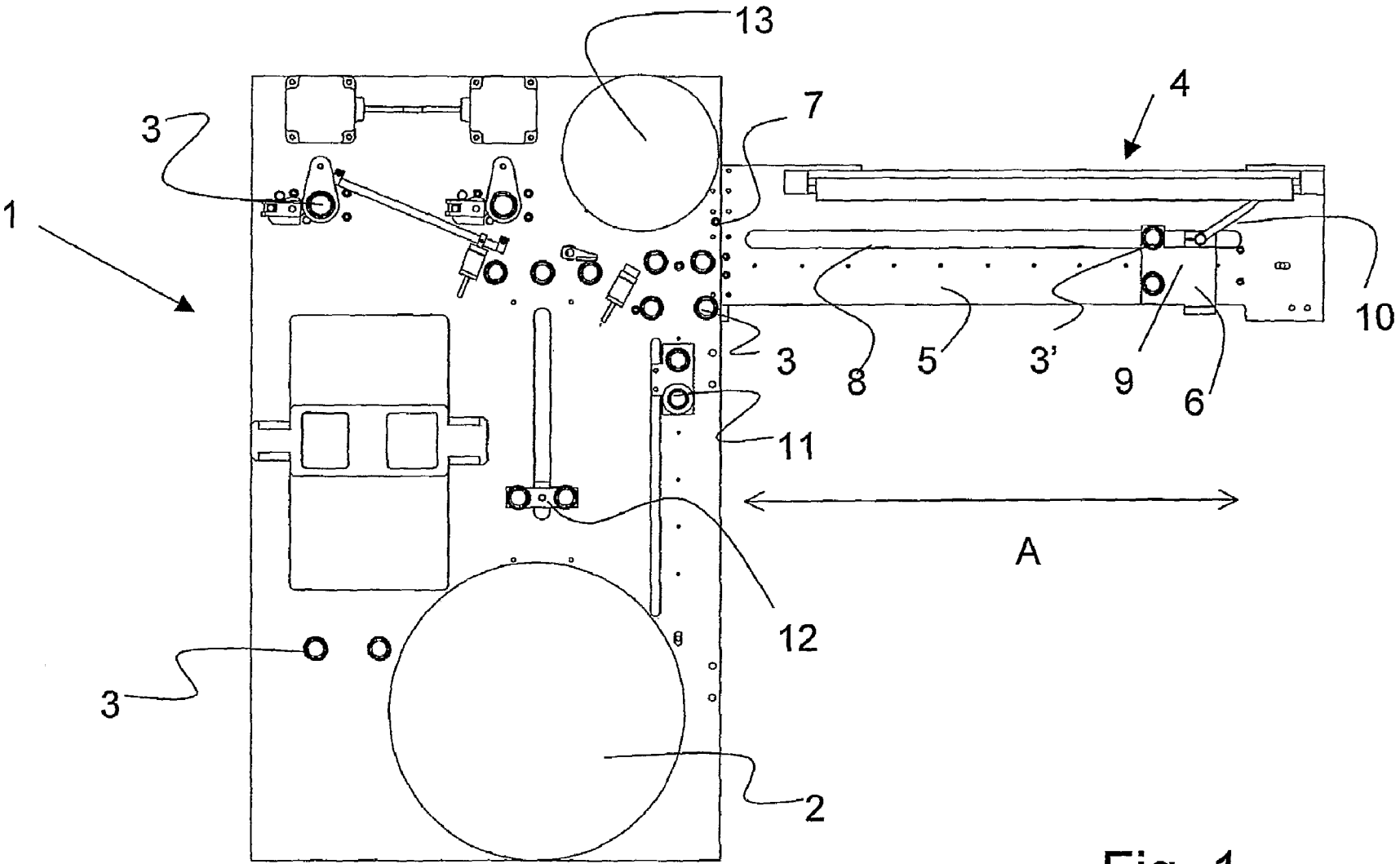
FIG. 1 shows the device according to the invention.

A preferred embodiment of the device 1 according to the present invention is shown in FIG. 1. The device 1 is to be used in connection with dispensing a plurality of labels onto a folio (not shown) across a travelling path of the folio through the device.

Figure 4:
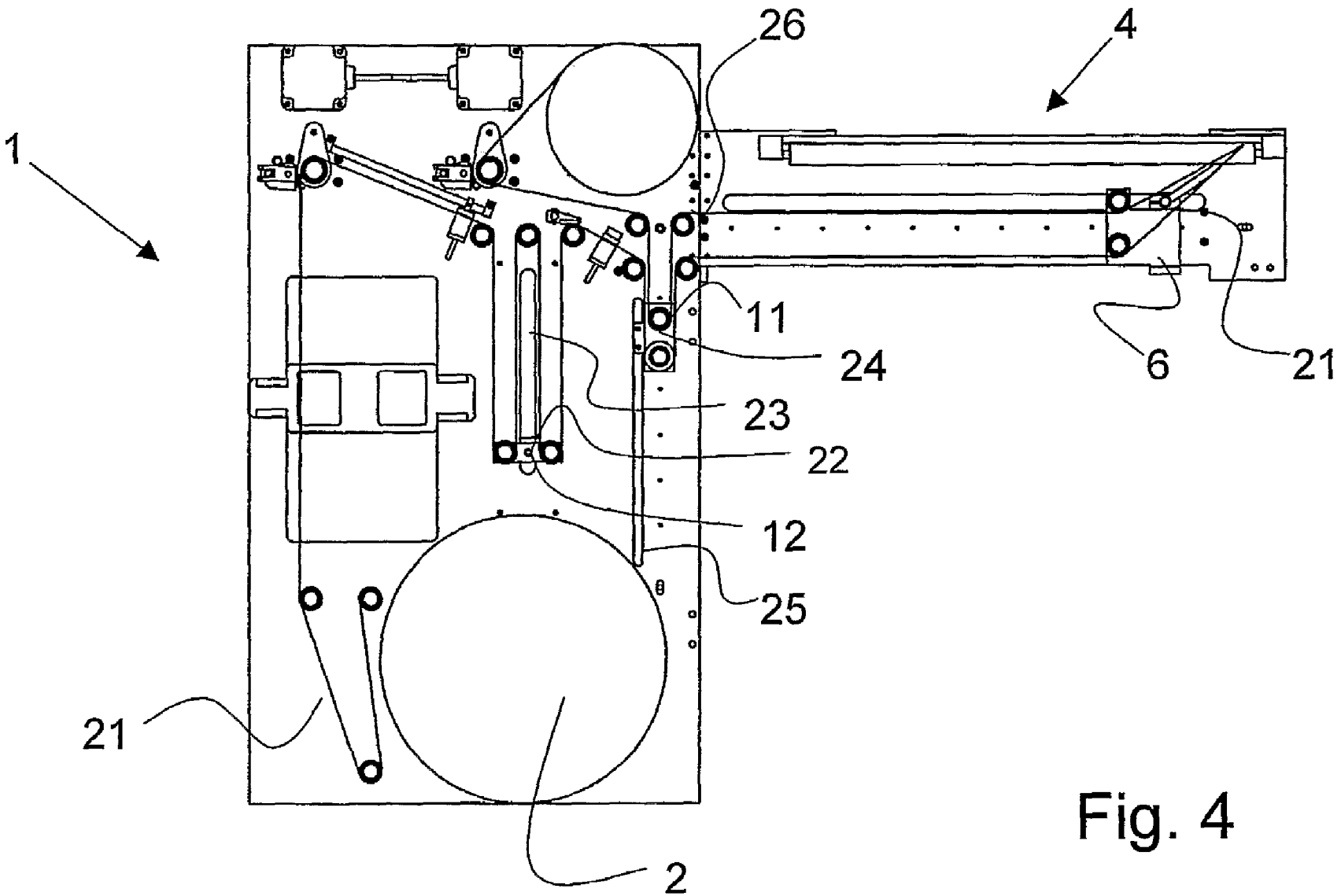
FIG. 4 shows the device according to the invention in a starting position ready for dispensing labels.
Figure 5:
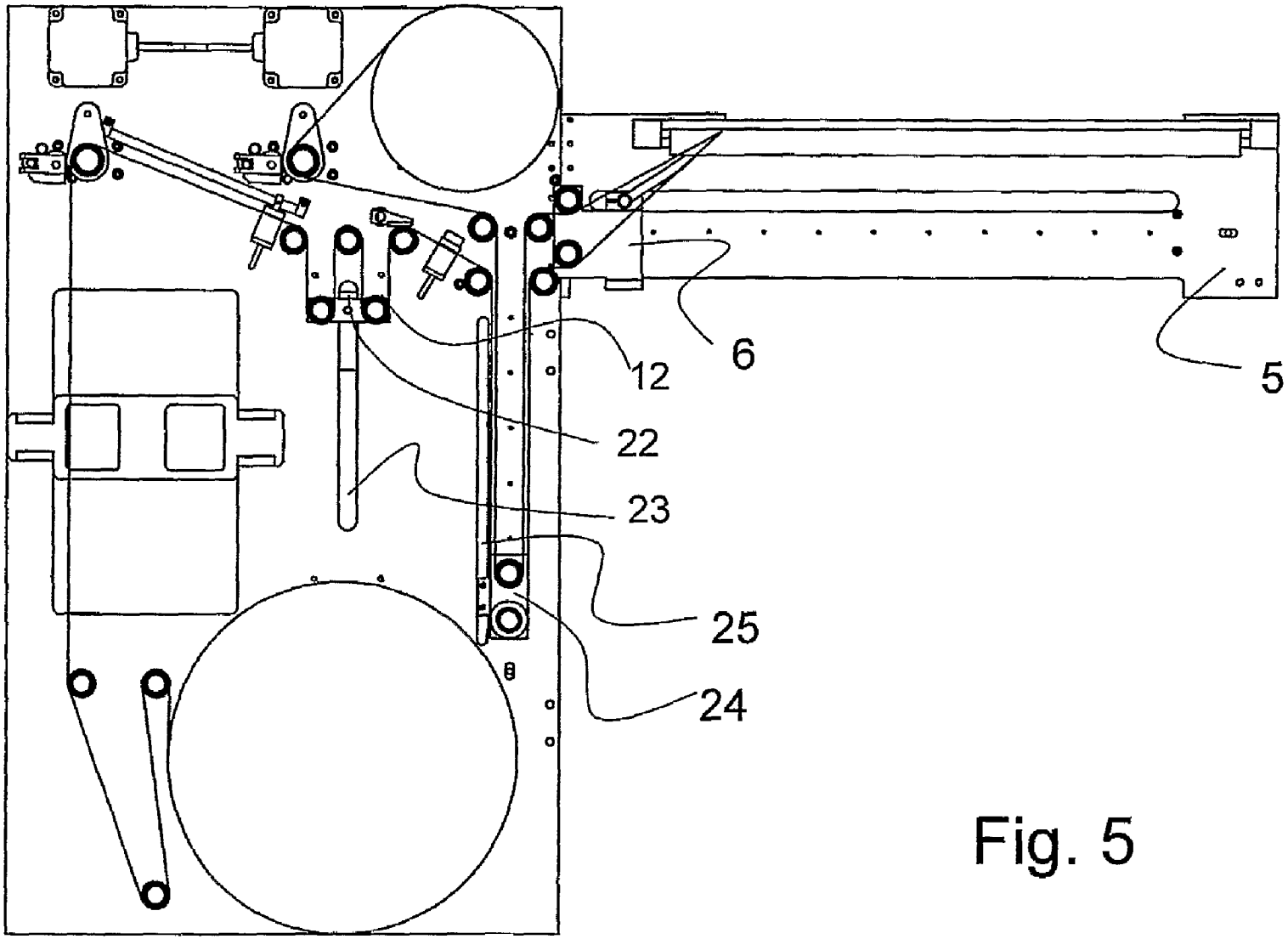
FIG. 5 shows the device in an end position after having dispensed labels across a folio.

The device 1 comprises a supply 2 of labels, which labels are carried by a carrier (not shown) and a guide system 3 for guiding the carrier with labels from the supply 2 to a dispensing means 4. The guide system 3 consists of a plurality of rollers 3, which are placed so that they serve as turning points for the carrier, during its travel from the supply 2 to the dispensing means 4. The rollers 3 are adapted to be rotable. In FIGS. 4 and 5 the device 1 is shown with a carrier mounted in the device 1 and the guidance of the carrier will be explained further in relation to these figures.

The dispensing means 4 comprises an arm 5, which extends across the folio (not shown), and a dispensing wagon 6, which is arranged on the arm 5 and is adapted to dispense the labels onto the folio while moving along the arm 5.

In this embodiment of the invention the folio is arranged to travel through the device 1 above the dispensing wagon 6 so that the labels will be dispensed onto the folio from below. However, which will be appreciated by a skilled person the dispensing means may be arranged to dispense labels from above.

The extension of the arm 5 is adapted to the breadth of the folio, onto which labels are to be dispensed. The arm 5 has rigid and firm connection 7 to the rest of the device 1 so that the positioning of the arm in relation to folio is precise. Furthermore, it is important that the arm is made of a rigid material so that any movements or vibrations of the arm during operation of the device is avoided or at least reduced to a minimum, which thereby will have no influence on the positioning of the labels on the folio.

In addition, the arm 5 is arranged with a groove 8 wherein the dispensing wagon 6 is adapted to be driven back and forth, which is indicated by the arrow A. It is within the inventive idea that the guidance of the dispensing wagon may be carried out in other ways, for instance by using a rail.

The dispensing wagon 6 is driven back and forth on the arm 5 by means of a motor, preferably a servo motor, which will be explained further in relation to FIG. 3. The dispensing wagon 6 comprises a chassis 9 as well as two rollers 3' and applying means 10, here in the form of a tongue.

According to the invention the device 1 also comprises means 11 for keeping the carrier with a predetermined stretch, which means is arranged between the supply 2 and the dispensing means 4. The function of this means will be explained further in connection with FIGS. 4 and 5.

The device 1 further comprises a buffer unit 12 for containing a supply of labels, which buffer unit 12 being arranged in connection with the means 11 for keeping the carrier with the predetermined stretch. The function of this buffer unit will be explained further in connection with FIGS. 4 and 5.

A storing unit 13 for the empty carrier is arranged in connection with the dispensing means 4. Advantageously, means 11 for keeping the empty carrier with a predetermined stretch is arranged between the dispensing means 4 and the storing unit 13, said means preferably being connected to the means 11 arranged between the supply 2 and the dispensing means 4.

Figure 2:
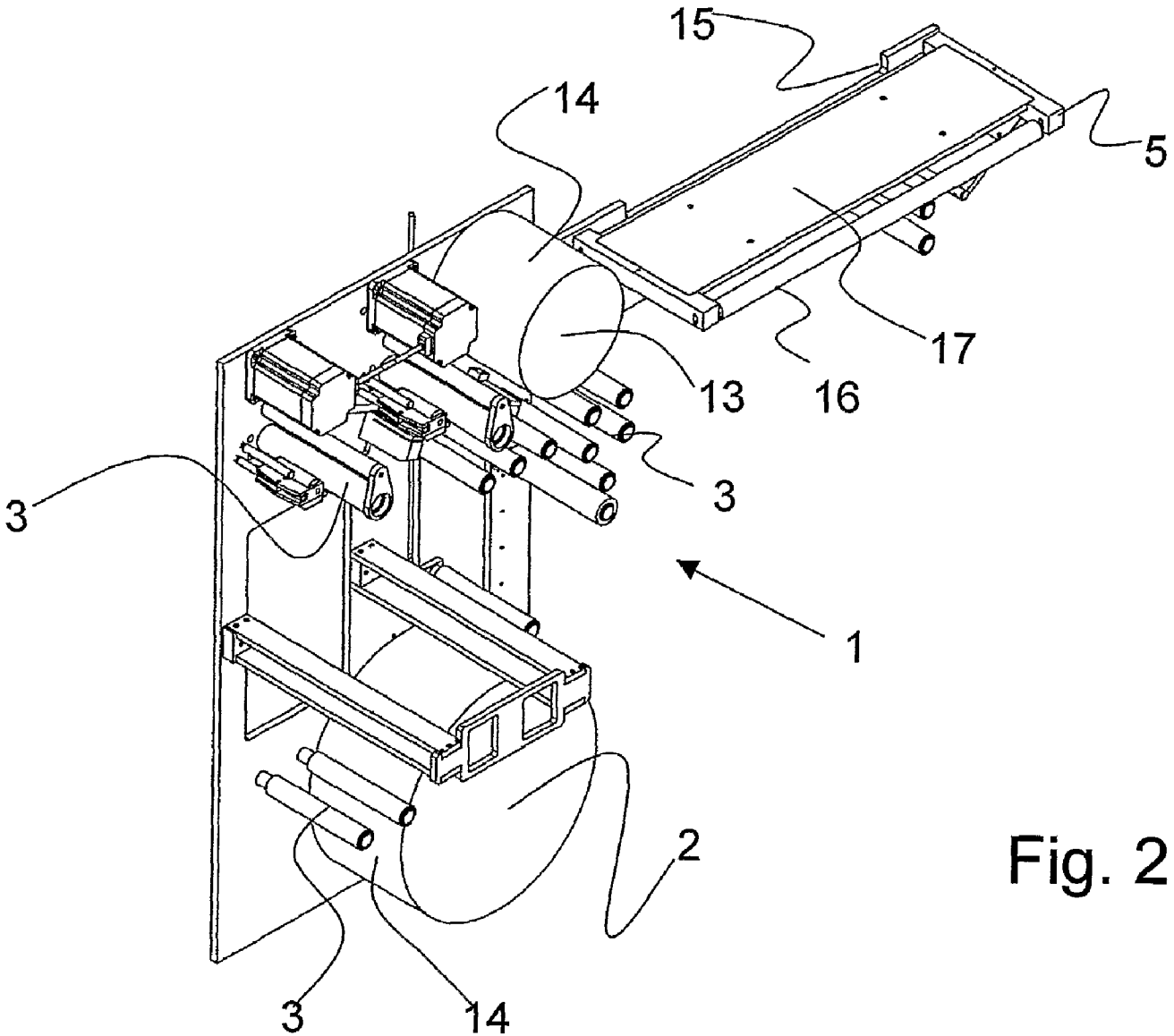
FIG. 2 shows the front of the device according to the invention in a perspective view.

In FIG. 2 the device 1 according to the invention is shown in perspective. From this view it is seen that the rollers 3 have a larger extension than the breadth of the carrier carrying the labels which is indicated by the breadths 14 of the supply 2 and the storing unit 13.

The arm 5 also comprises a recess 15 and a roller 16 for guiding the folio (not shown) through the arm 5. Furthermore, a support surface 17 is arranged to support the folio when the label is being dispensed onto the folio by means of the tongue.

Figure 3:
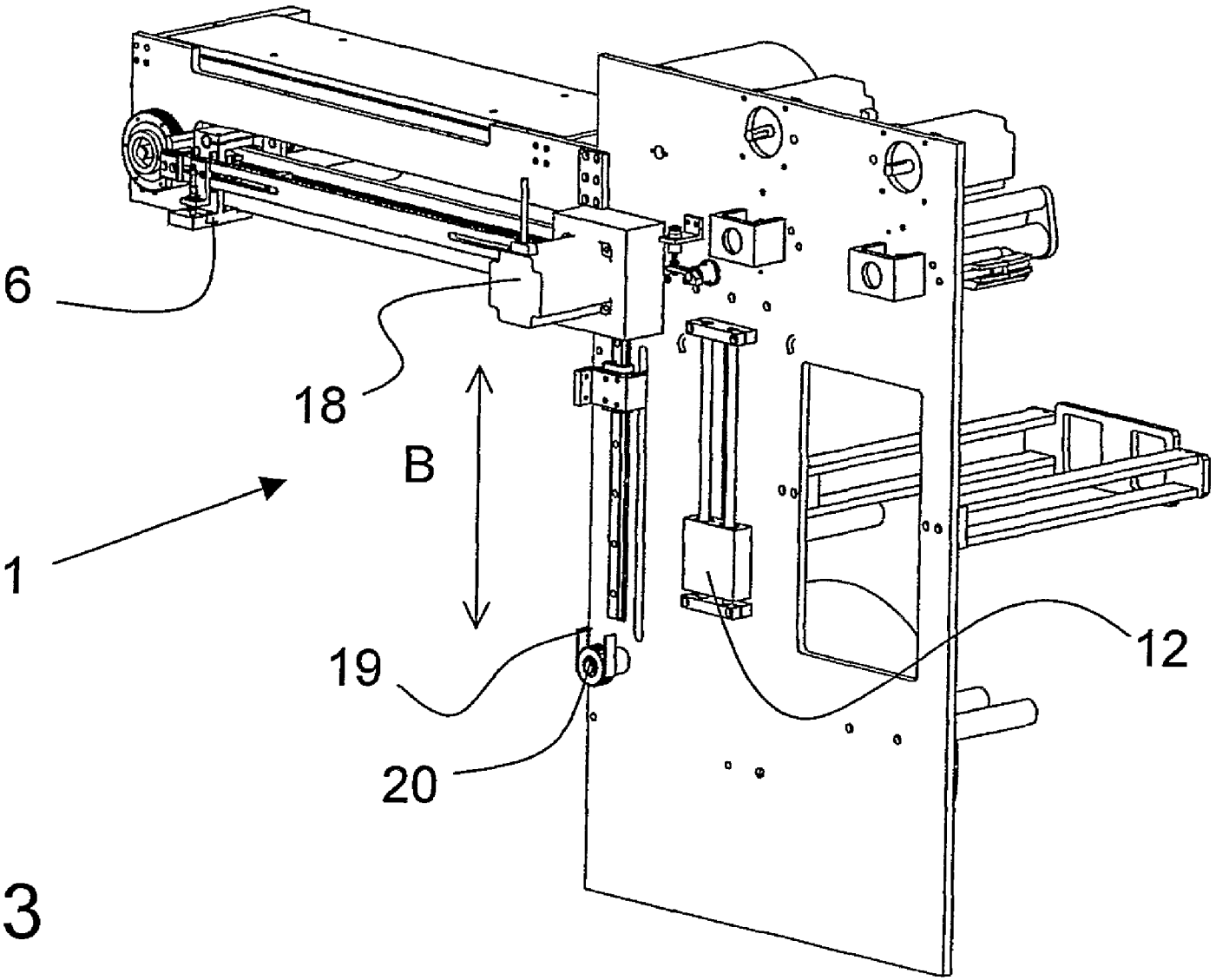
FIG. 3 shows the back of the device in a perspective view.

In FIG. 3 the device 1 is shown in perspective as seen from the back. On the back of the device the drive means for the means 11 may be seen, and the dispensing wagon 6 as well as buffer unit 12 are arranged.

The drive means for the means 11 is preferably a servo motor 18 which is adapted to move a slide (which will be explained further in connection with FIGS. 4 and 5) back and forth, as indicated by arrow B, by means of a precision belt 19. The precision belt is in this embodiment only shown partly extending around a lower turning point 20, but extends, of course, all the way up to the motor 18. By using a precision belt, instead of for instance a normal cogged V-belt, a high precision of the movement of the slide is obtained, which furthermore limits the clearance of the device so precise positioning of the labels onto the folio is obtained.

The drive means may furthermore drive the buffer unit 12 as well as the dispensing wagon 6 which will be appreciated by the skilled person.

In FIG. 4 the device 1 is shown having the carrier 21 mounted and guided through the device 1. The dispensing wagon 6 is in a first position ready for dispensing labels onto a folio.

In this first position the buffer unit 12 contains a supply of labels, which is seen by the slide 22 which is placed in the lowest position of the groove 23 wherein the slide 22 is adapted to move. When the slide 22 is in this low position the distance the carrier 21 has to travel from the supply 2 to the dispensing means 4 has been extended. With this extension a supply of labels close to the dispensing means 4 is obtained, whereby the inertia of the label roll in the supply 2 is not relevant.

Furthermore, in this first position the means 11 for keeping the carrier with the predetermined stretch comprises a slide 24, which is in connection with the drive means 18. The slide 24 is adapted to move back and forth in relation to the back and forth movement of the dispensing wagon 6 on the arm 5, thereby continuously changing the distance between the supply 2 and the dispensing wagon 6 in relation to the instantaneous position of the dispensing wagon 6 on the arm 5. The slide 24 is being moved in a groove 25. In this first position the slide 24 is in the uppermost position of the groove 25.

During operation of the device 1 the folio, which is to be labelled, is led to the device 1, i.e. the arm 5. When the folio reaches a predetermined position, i.e. the position where the labels are to be placed, it stops and the dispensing wagon 6 starts to move from the first position in the right of FIG. 4 towards left and at the same time dispensing labels from the carrier 21 onto the folio (not shown). During this dispensing of labels the motor which drives the dispensing wagon is adapted to accelerate the dispensing wagon so that the label will be released from the carrier at the end of the tongue 10. A major advantage of the device is that the labels are dispensed directly onto the folio from the carrier without being exposed to the air, so that a hygienic (and thereby not contaminated) area between the label and folio is obtained. A further advantage of the present invention is that the labels are dispensed onto the folio in a sideways manner by means of the tongue 10 whereby substantially no air bubbles are present between the label and the folio.

While the dispensing wagon 6 moves to the left the slide 24 starts to move downwards in the groove 25 so that the stretch of the carrier at all times is kept at the predetermined value. By this movement of the slide 24 it is also obtained that the empty carrier 26 is kept stretched at a predetermined value, due to the fact that the empty carrier is in connection with the slide 24.

At the same time the slide 22 of the buffer unit 12 is starting to move upwards and thereby changing the distance as well as the supply of labels.

When the dispensing wagon 6 reaches a second position, which is shown in FIG. 5, the dispensing wagon 6 has dispensed labels across the entire folio. At this second position, the slide 22 of the buffer unit 12 is in the uppermost position in the groove 23 and the slide 24 is in the lowermost position in the groove 25.

Hereinafter the dispensing wagon 6 will move towards the right of the arm 5, the slide 22 will move downwards (filling the buffer with labels) and slide 24 upwards until they all take the positions shown in FIG. 4 being ready for dispensing a new row of labels onto the folio, which folio has been moved at the same time so that a new part of the folio has been led to the dispensing area.

Furthermore, the device may comprise a control unit (not shown), the control unit is adapted to control the dispensing of labels in relation to the speed of the folio as well as to the speed of the movement of the slides 22, 24 and may control the speed of the dispensing wagon.

Even though, the device according to the invention is explained in relation to a single row dispensing device, a number of devices arranged in succession (in row) after each other may be applied.

According to an embodiment of the invention, a printer (not shown) may be arranged in connection with guiding system of the carrier so that information may be printed on the labels before they are being dispensed.

Often the carrier carrying the labels is made of a paper-like material. In this instance the predetermined stretch of the carrier shall be set so that the carrier is not damaged during its travel through the device. It is vital that the carrier not be damaged before as well as after dispensing of the labels.

Furthermore, the device according to the invention is easily operable for the user and has little waste of labels due to the fact that the labels are first removed from the carrier during actual dispensing onto the folio. Thus, the device needs substantially no cleaning and a only a little maintenance.

A further advantage is that the device according to the invention may be formed as a kit which easily may be incorporated in existing packaging lines.

Although the invention above has been described in connection with preferred embodiments of the invention, it will be evident for a person skilled in the art that several modifications are conceivable without departing from the invention as defined by the following claims.

The invention claimed is:

1. A device for dispensing a plurality of labels directly from a carrier onto a folio, across a travelling path of the folio through the device, said device comprising a supply roll of labels on a carrier, a dispensing means, a guide system for guiding the labels from said roll to said dispensing means, said dispensing means comprising an arm which extends across a folio, and said device further comprising a dispensing wagon, said dispensing wagon being arranged on the arm and adapted to dispense the labels directly onto the folio while moving along the arm; said device further comprising a stretching means for keeping the carrier with a predetermined stretch between said roll and the dispensing means.

2. A device according to claim 1, additionally comprising a buffer unit wherein said buffer unit is configured for containing said carrier and said supply of labels and is adapted to cooperate with said stretching means.

3. A device according to claim 1, additionally comprising a storing unit wherein said storing unit for said carrier and said supply of labels is configured to cooperate with said dispensing means.

4. A device according to claim 3, wherein said stretching means is positioned between the dispensing means and the storing unit.

5. A device according to claim 1, wherein the stretching means comprises a slide connected to a drive means, said slide being adapted to move back and forth in relation to the back and forth movement of the dispensing wagon on the arm, thereby continuously changing the travelling distance between said supply roll of labels and the dispensing wagon in relation to the instantaneous position of the dispensing wagon on the arm.

6. A device according to claim 5, wherein the drive means comprises a servo motor, said servo motor being adapted to move the slide back and forth by a precision belt.

7. A device according to claim 2, wherein the buffer unit comprises a slide connected to a drive means, said slide being adapted to move back and forth in relation to the back and forth movement of the dispensing wagon on the arm wherein the travelling distance between the supply roll of labels and the dispensing wagon continuously changes so that said supply of labels contained in the buffer unit relates the instantaneous dispensing need of labels at all times at the dispensing wagon.

8. A device according to claim 7, comprising a control unit wherein said control unit is adapted to control the dispensing of labels in relation to the speed of the folio as well as to the speed of the movement of the slides.

9. A device according to claim 1, comprising a printer wherein said printer is configured to cooperate with said guide system so that labels are printed before they are dispensed.

* * * * *